United States Patent [19]

Wakamatsu et al.

[11] 4,251,977

[45] Feb. 24, 1981

[54] METHOD OF AUTOMATICALLY PACKING END CLOSURES FOR CANS IN PAPER BAGS

[75] Inventors: Atsuyuki Wakamatsu, Shimizu; Haruo Tsuwano, Shizuoka, both of Japan

[73] Assignee: Daiwa Can Co., Ltd., Tokyo, Japan

[21] Appl. No.: 37,694

[22] Filed: May 10, 1979

[51] Int. Cl.[3] ..... B65B 35/42; B65B 35/48; B65B 43/34; B65B 57/20

[52] U.S. Cl. ..... 53/443; 53/469; 53/501; 53/532; 53/542; 53/258; 53/370

[58] Field of Search ..... 53/443, 446, 469, 479, 53/501, 532, 542, 254, 258, 370; 414/107

[56] References Cited

U.S. PATENT DOCUMENTS

| | | | |
|---|---|---|---|
| 3,535,847 | 10/1970 | Strohmeier et al. | 53/501 |
| 3,563,002 | 2/1971 | Givin | 53/370 X |
| 3,732,665 | 5/1973 | Pitts | 53/542 X |
| 3,962,845 | 6/1976 | Mojden et al. | 53/542 X |

*Primary Examiner*—Travis S. McGehee
*Attorney, Agent, or Firm*—Watson, Leavenworth, Kelton & Taggart

[57] ABSTRACT

End closures for cans fed horizontally at given intervals at a high speed are shifted in direction, one after another, to be substantially perpendicular to a support passage extending substantially horizontally, received separately by the passage rapidly and positively, and lotted out when a predetermined number has been reached by the pieces received. Each lot thus compacted to a solid cylindrical form is put into an elongate paper bag, and the open end of the bag is closed.

4 Claims, 18 Drawing Figures

Fig. 12
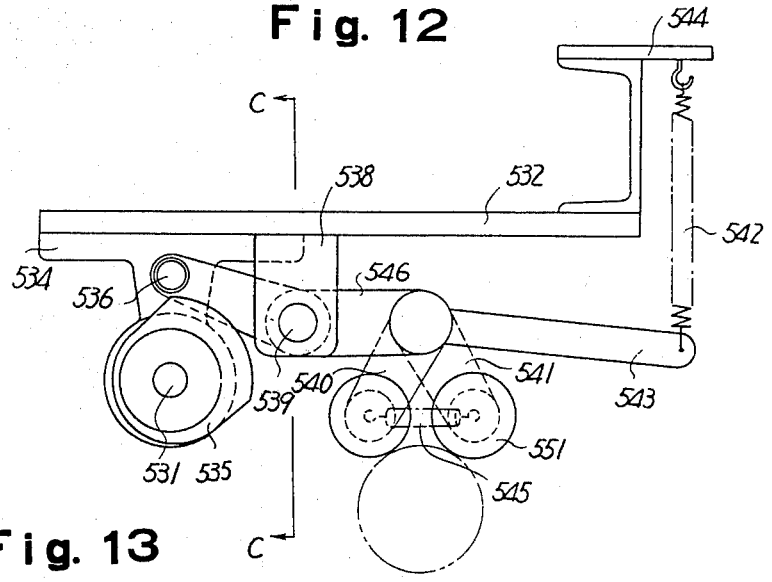
Fig. 13
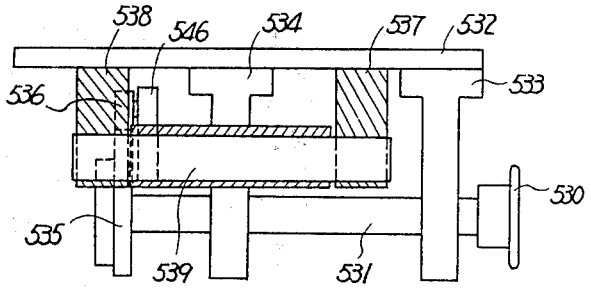
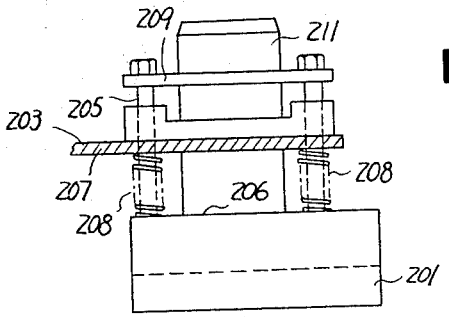
Fig. 15

METHOD OF AUTOMATICALLY PACKING END CLOSURES FOR CANS IN PAPER BAGS

BACKGROUND OF THE INVENTION

This invention relates to a method of gathering a predetermined number of circular end closures for cans into a lot of cylindrical form, putting it into a paper bag, and closing the open end of the filled bag, all in automatic, high-speed operation. More particularly, the invention is concerned with a method which comprises shifting the direction of end closures for cans being fed horizontally at given intervals at a high speed, one after another, to be substantially perpendicular to a support passage extending substantially horizontally, receiving the pieces separately in the passage at a high speed and in positive way, lotting out the end closures when a predetermined number has been reached by the pieces received, compacting each such lot to a cylindrical form and putting the lot into an elongate paper bag, and then closing the open end of the bag.

As a method of packing a lot of end closures compacted to a solid cylindrical form, a practice is well known which consists of placing a cylindrical lot of a predetermined number of end closures over a spread sheet of paper, wrapping the sheet round the cylinder, and then glueing the outer end portion of the sheet to the underlying layer. However, the procedure is disadvantageous because it necessitates much time for the wrapping and glueing and fails to provide a completely closed bag. Moreover, no attempt has hitherto been made to count up exactly the number of end closures being fed at a high speed of 300 pieces a minute and divide the total on the basis of the count into lots of a predetermined number of pieces.

SUMMARY OF THE INVENTION

The present invention has for its object to provide a method which eliminates the above-mentioned disadvantages by dividing a row of end closures for cans being fed at a high speed into lots of a predetermined number of the end closures at a high speed and accurately, introducing each lot into a paper bag, and then completely closing the open end of the bag.

Many other features, advantages and additional objects of the present invention will become manifest to those versed in the art upon making reference to the detailed description which follows and the accompanying sheet of drawings.

In accordance with the invention, a method of automatically bagging end closures for cans is provided which comprises the steps of shifting the position of end closures placed horizontally on an endless belt and fed at given intervals, one after another, to be substantially perpendicular to a support passage which extends substantially horizontally and receiving the end closures in the support passage, counting the number of the end closures being fed before they are shifted to the perpendicular position and lotting out the end closures received by the support passage to form a lot of a predetermined number of pieces, introducing the lot into an elongate paper bag being supported with its open end kept wide open, and closing the bag packed with the lot of end closures by twisting the open end. In this method the step of receiving the end closures in the support passages may comprise receiving the end closures in such a way that each piece is inclined with the lower portion thereof ahead of the upper portion in the same passage, attracting by suction the forwardly inclined lower portion of the piece rearwardly and the upper portion forwardly to bring the piece to an upright position substantially perpendicular to the support passge, and forcing such upright pieces forward through two rotating rolls. The step of lotting out the end closures to form a lot may comprise counting the number of end closures being fed at a point before they are inclined, supplying lotting pawl actuator means with a signal indicating that a predetermined number of end closures has been counted, bringing lotting pawls into contact, in response to the signal, with the rearmost of a pack of end closures that has passed through the rotating rolls, moving the lotting pawls forward a sufficient distance to prevent any fall to the horizontal of the frontmost piece of the following lot as it passes through the rolls, and then moving the lot of end closures forward after the frontmost one has been stabilized against falling under the impact that the ensuing pieces receive as they pass through the rolls. The step of opening each paper bag may comprise pinching a flat, elongate paper bag, which is closed at one longitudinal end and open at the other, at the both edges of the opening parallel to the axis of the bag, and attracting by suction the superposed layers of the opening between the pinched edges apart, upward and downward, to form a round opening. The step of introducing the lot of end closures into the open paper bag may comprise inserting a hollow guide cylinder into the open portion of the bag, pressing the bag against the outer surface of the guide cylinder and thereby firmly holding the bag, and introducing the lot of end closures through the hollow of the guide cylinder into the bag so held in position. Further, the step of closing the open end of the paper bag may comprise releasing the pinch of the open end of the bag following the introduction of end closures therein and withdrawing the guide cylinder from the bag, bringing open legs of a pair of pincer-like members close to each other to squeeze the open end of the bag, further squeezing the open end while giving rotation along the longitudinal axis of the paper bag to the portion of the bag filled with the end closures, and rotating the filled portion of the bag whose opening has been further squeezed.

BRIEF DESCRIPTION OF THE DRAWINGS

FIG. 12 is a front view of an upper turning section for turning the paper bag packed with a lot of end closures;

FIG. 13 is a view looking in the direction of the arrows c—c of FIG. 12;

FIG 15 is a sectional view looking in the direction of the arrows d—d of FIG. 14;

DETAILED DESCRIPTION OF THE INVENTION

The method of the present invention will now be described with reference to the drawings showing the apparatus adapted for practicing the same.

Figure 2:
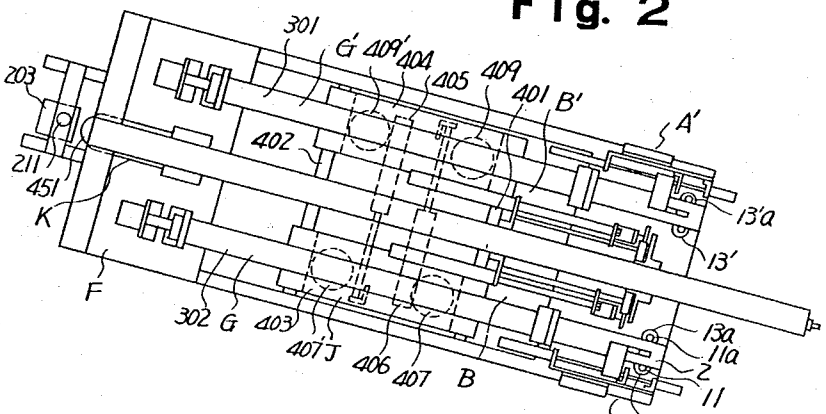
FIG. 2 is a plan view looking in the direction of the arrows a—a of FIG. 1 (corresponding to about right-hand half of the same figure), showing sections for receiving end closures for cans, dividing them into lots, and conveying the lots.
Figure 3:
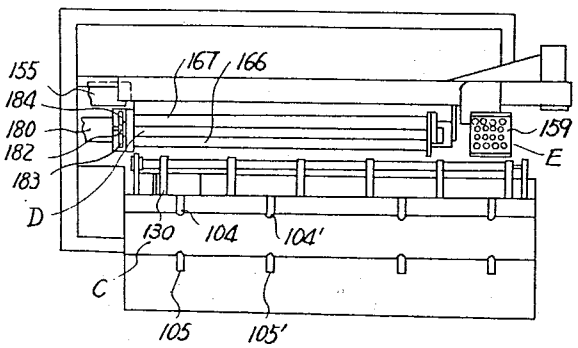
FIG. 3 is a diagrammatic view looking in the direction of the arrows b—b of FIG. 1, showing a section for putting each lot into a paper bag and closing the bag.
Figure 1:
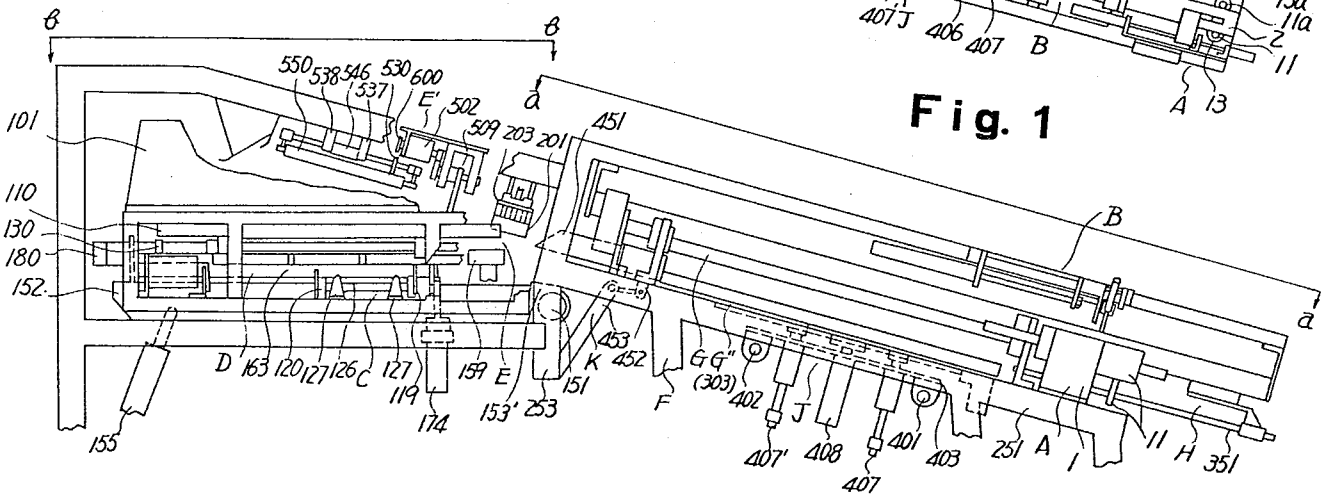
FIG. 1 is a party broken general front view of an apparatus adapted for practicing the method of the invention.

Referring now to FIGS. 1, 2 and 3, the apparatus according to the invention comprises sections A, A' where end closures for cans are received and divided into lots, auxiliary feed sections B, B' for pushing the lots of the end closures a considerable distance forward, a puller section C for pulling out paper bags, one after another, from a stack, a bag-supporting section D for supporting each paper bag pulled out into position, a section E for opening each paper bag, a closing section E' for twisting and closing the bag, a frame section F, support troughs G, G', G'' which serve as passages for supporting and conducting the end closures, a transfer section J for transferring the lots of end closures from support troughs G, G' to trough G'', and a guide part K for guiding the lots of end closures as they are packed in the paper bags. The apparatus also includes, although not shown, a compressed-air distribution system and drives for all the sections and parts.

Figure 4:
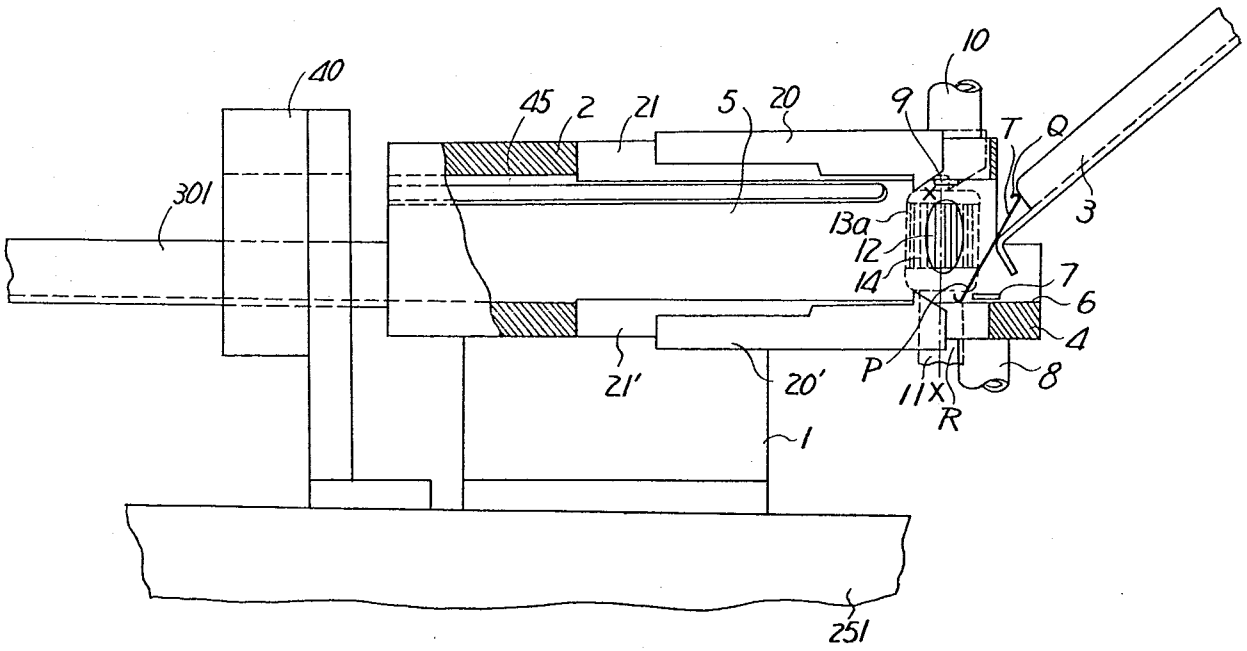
FIG. 4 is a partly sectional front view of a section for receiving end closures in a support passage.

The sections A, A' for receiving and lotting out end closures, which lie symmetrically in parallel with respect to the longitudinal axis of the apparatus, are constructed identically. Therefore, only the section A will be hereinafter described in detail. Turning to FIGS. 1, 2 and 4, the section A comprises a hollow cylinder 2 attached to a support plate 1 fast on a lower frame 251 and which extends substantially horizontally to form part of an end-closure support passage; a chute 3 for feeding end closures (see FIG. 4) which terminates inwardly of hollow cylinder 2, at a point away from the extremity 4 of an extended lower portion 6 at the entrance of the cylinder but short of the inner wall of the lower portion; a lower air suction port 7 which opens at a point near the lower end portion 4 of hollow cylinder 2 and communicates with evacuating means not shown via pipe 8; an upper air suction port 9 which opens at a point of the upper side of hollow cylinder 2, ahead of the upper portion of each end closure T slid down through chute 3, and in the proximity of the centerline of a roll 13 to be described below; a pair of oppositely rotatable rolls 13, 13' having peripheral surfaces partly entering the hollow 5 of cylinder 2 through windows 12 formed in the latter, at a point beyond the inner wall 6 of the cylinder, said rolls being located slightly ahead of the edge R of the lower portion P of each end closure T and made rotatable about the axes of vertical rotary shafts 11, 11*a;* and elastic means (not shown) biasing rolls 13, 13' toward the hollow 5. Rolls 13, 13' have vertical flutes 14, 14', respectively, formed on the peripheral surfaces in parallel with the axes thereof. The two rolls are spaced a sufficient distance for each end closure to pass, forcing the rolls apart with the diametrally opposite edges of the piece caught in vertical flutes 14, 14'.

Figure 5:
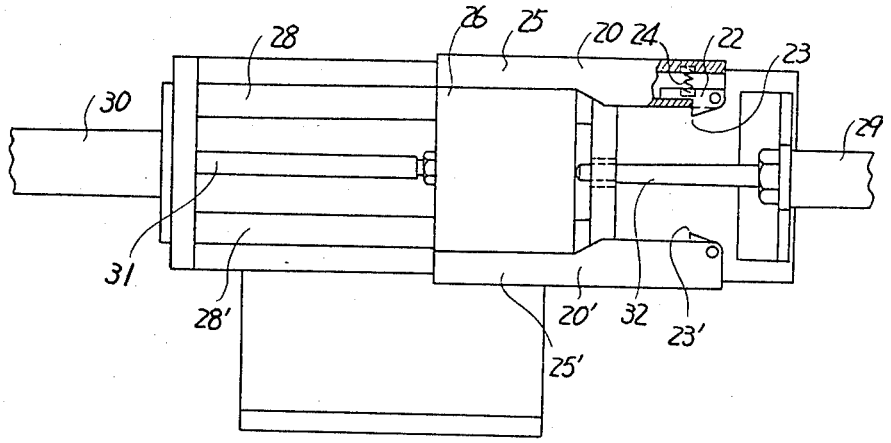
FIG. 5 is a partly broken plan view of lotting pawls and drives therefor.
Figure 6:
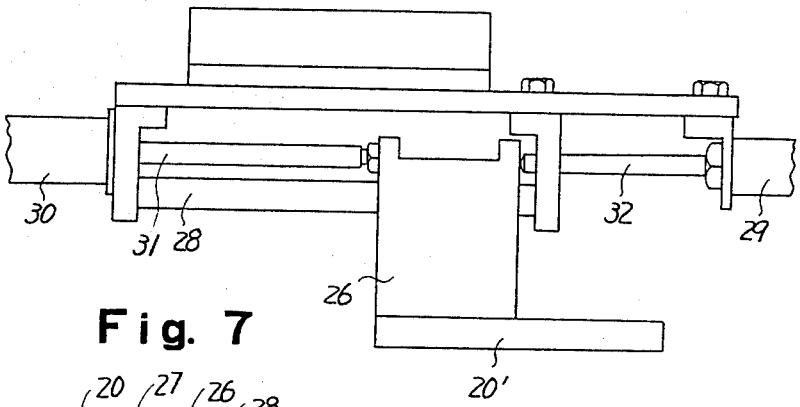
FIG. 6 is a front view of the components shown in FIG. 5.
Figure 7:
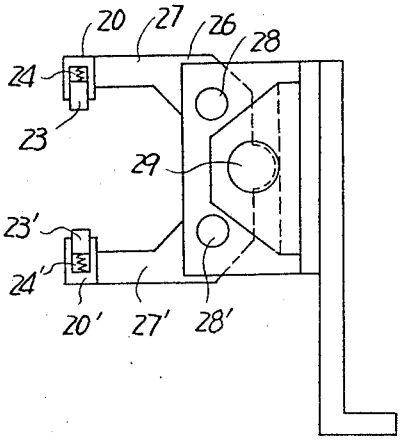
FIG. 7 is a side view of the components of FIG. 5.

Also, as shown in FIGS. 5, 6 and 7, the section A for receiving and lotting out end closures comprises slots 21, 21' formed axially in the upper and lower portions of hollow cylinder 2; lotting pawls 22, 22' adapted to reciprocate within slots 21, 21'; and springs 24, 24' (the latter being not shown) biasing the lotting pawls 22, 22' toward the hollow 5. The section further includes lotters 20, 20' carrying the lotting pawls at one ends; a saddle 26 having two extensions 27, 27' to which the other ends of lotters 20, 20' are attached; air cylinders 29, 30 for moving the saddle back and forth horizontally; guide rods 28, 28' for guiding the saddle during the reciprocating movement; and a connecting rod 31 which connects saddle 26 with the piston of air cylinder 30, and a rod 32 secured to the piston of the other air cylinder to push saddle 26. Tips 23, 23' of lotting pawls 22, 22' are spaced a distance slightly less than the diameter of end closures and are both projected a little into the hollow 5.

With the construction described, the section A for receiving and lotting out end closures operates in the following way. As each of end closures T for cans slides downward through chute 3 to the position indicated in FIG. 4, the lower portion P of the end closure is attracted rearward by a stream of air flowing into the lower air suction port 7, and the upper portion Q is attracted frontward by a stream of air directed to the upper air suction port 9, with the consequence that the workpiece stands upright. The piece, now in contact at the periphery with the exterior surfaces of rolls 13, 13', is held by vertical flutes 14, 14' and moved forward by the rolls running inwardly of the hollow 5. While resisting the forces with which the rolls are biased toward each other by the elastic means, the end closure extends the gap in between and passes the line X—X (FIG. 4) connecting the centers of the rolls, and then it springs out to the front of the rolls. At this point, the tips 23, 23' of lotting pawls 22, 22' are substantially on the line X—X, with the gap in between slightly smaller than the diameter of the end closure as already noted. However, the end closure, fitted in vertical flutes 14, 14' of the rolls, can force pawls 22, 22' apart and moved past them frontwards.

The words "front" and "rear" as used herein means, respectively, the left- and right-hand sides as viewed in FIG. 1. In other words, the side ahead of each end closure being handled is the front and the side behind it is the rear.

Rolls 13, 13' run so fast that the end closure that has come into contact with them is instantly forced beyond the line X—X to the front. In this manner end closures are, in succession, carried frontward past the line X—X. Before the individual end closures reach the position T in FIG. 4, the number is counted by some suitable optical counter of a well-known type. Each time a predetermined number has been counted off, the counter signals drives of air cylinders 29, 30 to actuate the cylinders. Lotters 20, 20', with tips 23, 23' of pawls 22, 22' subtantially on the line X—X, are then moved frontward, conveying through the passage the predetermined number of pieces as a lot separated by pawls 22, 22' from the rest. The distance over which each lot of end closures is conveyed forward by the lotting pawls range usually from about 15 to about 30 mm. In any case the distance has only to be such that, behind the preceding lot so separated, the first piece of the next lot being fed by rolls 13, 13' is prevented from falling unsupportedly forward. When end closures have gathered in the space between lotting pawls 22, 22' in the advanced position and rolls 13, 13' to such a lot that they do not fall any longer under the impact of the ensuing pieces being driven out of the rolls (that is, after a predetermined number of end closures, which depends on the kind of material, size and other factors of the pieces, have gathered), lotters 20, 20' further advance an appropriate distance, pushing the lot of end closures accordingly. The lotters are the withdrawn at a suitable point of time by the actuation of air cylinders 29, 30 to the position where the tips 23, 23' of the lotting pawls reach substantially the line X—X.

Located between and actuated by air cylinders 29, 30, lotters 20, 20' can stop stably in proper position within a short period of time.

In sections A, A' for receiving and lotting out end closures, the pieces are counted up while they are sliding downward along chute 3, just before they reach the lower end of the passage. The counting is, therefore, easy and accurate. As soon as each piece is raised upright, it is driven forward by rolls 13, 13' running at a high speed to a point beyond the line X—X that connects the centerlines of the rolls. This facilitates the division of the row of end closures into lots by means of the lotting pawls.

As can be seen from FIG. 2, the apparatus embodying the invention includes the end closure receiving-lotting units A, A' located on both sides, symmetrically with respect to the longitudinal centerline of the apparatus. On the centerline between the two units is provided means for introducing each lot of end closures into a paper bag and closing the filled bag. The lot separated forward from the rest of end closures by lotters 20, 20' is caused to advance farther through a trough 301 (or G). Next, the lot is transferred to a central trough G'' in the center (FIG. 1) and moved toward a paper bag. The lots of end closures in the left and right troughs 301 (or G) and 302 (or G'') are alternately shifted to central trough G'' in between. The lots are moved forward within troughs 301, 302 in order to prevent the following lots of end closures gathering in those passages from coming into contact with the preceding lots prior to the transfer to central trough G''.

Figure 8:
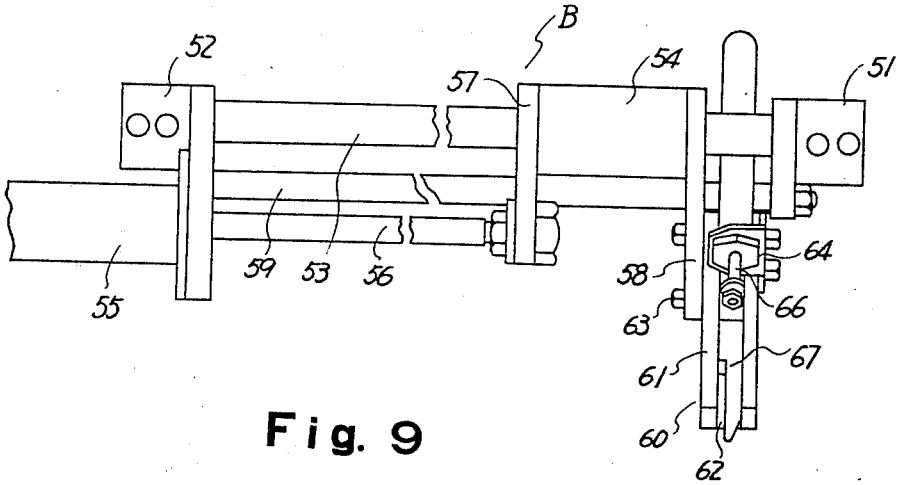
FIG. 8 is a front view of auxiliary feeder section and drives for forcing a lot of end closures, already moved forward by lotting pawls, a further long step forward.
Figure 9:
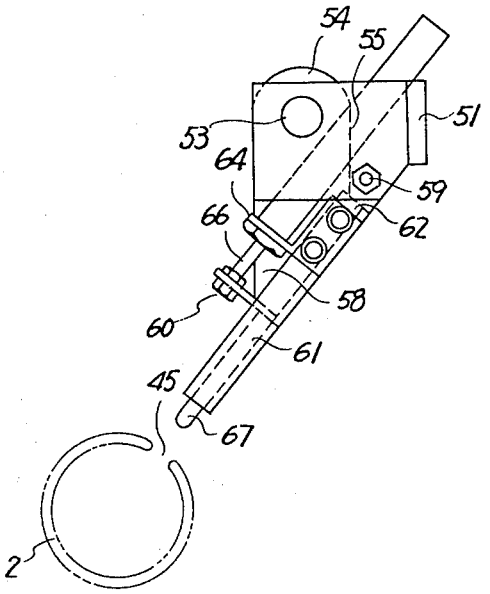
FIG. 9 is a side view showing relative position of a hollow cylinder and main feed pawl in support passage.

Auxiliary feed section B for conveying the lots further frontward will now be explained with reference to FIGS. 8 and 9. It comprises brackets 51, 52 attaching the entire section to the main frame, a guide rod 53 extended between and secured at both ends to the brackets, a slide 54 movable back and forth along the guide rod, an arm 57 suspended downward from one side of slide 54 and fixed to the piston connecting rod 56 of an air cylinder 55, an arm 58 suspended downward from the other side of slide 54 and carrying a kicker 60, and a rod 59 fixed to brackets 51, 52 at both ends and kept in contact with the outer side of slide 54 to help adjust the slide direction. Kicker 60 extends obliquely downward in the direction of the center of arc of hollow cylinder 2 (FIG. 9). It has a groove 62 formed longitudinally in the upper middle portion (FIG. 8) and includes a base plate 61 secured to arm 58 by bolts 63; a small solenoid-operated valve 65 supported by a support member 64 fast on the portion of base plate 61 opposite to the side secured to arm 58; and a feed pawl 67 attached to the front end of a movable stem 66 of solenoid valve 65 and made slidable within groove 62 of base plate 61. When the lot of end closures has completed the second stage of advance under the urgings of lotters 20, 20' in the manner described, feed pawl 67 is thrusted out by the small solenoid valve through slot 45 (FIG. 4) of hollow cylinder 2 into the space behind the rearmost piece of the lot. The pawl then pushes the lot forward a sufficient distance within trough 301 to leave behind a space large enough for collection of the predetermined number of end closures to form a next lot. When the preceding lot has fully covered the distance, its rearmost end closure is at a point just beyond a detent (not shown) provided in trough 301. Since the trough is slightly inclined upward to the front, the lot will remain engaged with the detent and will not slide backward when feed pawl 67 is retracted upward from trough 301 by means of solenoid valve 65. Following the upward retraction of feed pawl 67, auxiliary feed section B is reset to the initial position on hollow cylinder 2. This sequence of movements is accomplished by air cylinder 55.

Next, transfer section J for taking out the lot of end closures from trough 301, wherein they are held in place by the detent as above stated, and transferring the lot to the central region will be described.

Turning to FIGS. 1 and 2, transfer section J comprises two parallel guide rods 401, 402 located beneath trough 301 at right angles to the direction in which end closures advance and secured to the frame F; flat plates 403, 404 lying over and bridging guide rods 401, 402; an air cylinder 405 for moving flat plate 403 from one side of the apparatus to the central region and vice versa along both guide rods 401, 402, an air cylinder 406 for similarly moving flat plate 404 from the other side to the central region and backward; a trough 303 provided above and in parallel to flat plate 403 and extending parallelly with troughs 301, 302; a trough 304 (not shown) similarly located above flat plate 404; and guide members 409, 409', 407, 407' and air cylinders 410, 410' (all not shown) for moving flat plates 403, 404 upward and downward, both flat plates 403, 404 being adapted to carry lots of end closures alternately in troughs 303, 304 from trough 301, 302 to the central region and return to the original position.

Transfer section J operates in the following way.

First, trough 303 on flat plate 403, which is on one side of the apparatus, is positioned immediately below trough 302. Next, air cylinder 408 is actuated to raise trough 303 into superposition with trough 302 which holds the lot of end closures. Trough 302 is then rolled through an angle of 180 deg. or upside down, to form a cylindrical hollow body with trough 303 and transfer the lot to the latter. Together with the lot, trough 303 descends to a predetermined level. Meanwhile, trough 302 again turns upside down to the original position to be ready for the receipt of the next lot. Flat plate 403 with trough 303 is shifted to the central region by the actuation of air cylinder 405 and stops at the point where a push rod 351 (FIG. 1) of an end closure pusher H to be described later is substantially aligned to the center of arc of trough 303. At this time, trough 304 on the other flat plate 404 begins ascending toward trough 301 and, from thence onward, acts in the same way as flat plate 403.

Push rod 351 advances to force the lot out of trough 303 into the paper bag waiting open, and then withdraws to the initial position after the lapse of a predetermined period of time to be mentioned later. Flat plate 403 is brought back to the position of FIG. 2 by means of air cylinder 405, while flat plate 404 instead shifts to the central region. These actions are repeated.

In the apparatus embodying the invention, paper bags are handled while the end closures for cans are being made ready for packing.

Handling of the paper bags starts with pulling paper bags, one by one, at puller section C.

Paper bag stacker 100 (FIG. 10) includes a stacking chamber 103 defined by both vertical side walls 101, 102 extended longitudinally and vertical front and rear walls (not shown) for enclosing therein a stack of elongate paper bags, and tabs 104, 104' 105, 105' for separating paper bags, protruding horizontally from the lower ends of vertical side walls 101, 102 toward stacking chamber 103.

Figure 10:
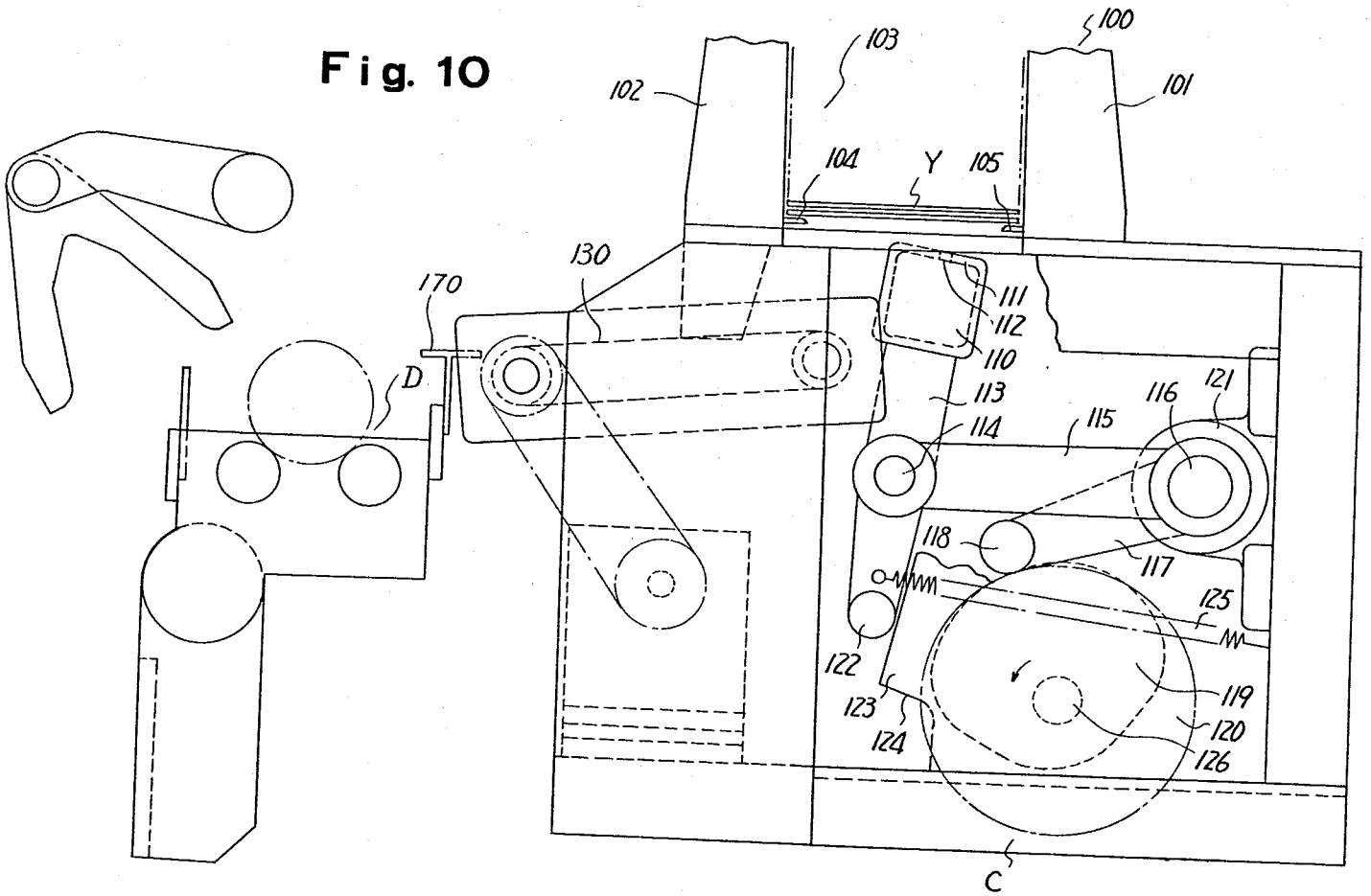
FIG. 10 is an explanatory view of arrangements for pulling out each of stacked flat paper bags from the bottom of the stack, showing relative position of a paper bag pusher section, conveyor belt, section for supporting the conveyed bag, and pincer-like members for pinching the opening of the bag.

The section C for pulling out, one by one, the paper bags Y from stacker 100 comprises, as shown in FIGS. 1 and 10, a suction duct 110 substantially equal in length to the paper bags in a stack and located in parallel with and beneath the bags that lie perpendicularly to the arrangements as viewed in FIG. 10; a suction port 112 formed in the upper surface 111 of the suction duct facing the bags; a lever 113 extended downward from the suction duct; a pin 114 fitted in a hole formed midway in the lever at right angles to the lever (perpendicularly to the figure); a connecting arm 115 one end of which is pivotally connected to pin 114; a pin 116 anchoring the connecting arm at the other end; a cam follower arm 117 secured at one end to pin 116; a cam follower roll 118 rotatably mounted on the other end of the cam arm; a generally triangular-shaped cam plate 119 in rolling contact with the cam roll; a wheel 120 for driving cam plate 119; a bearing 121 supporting pin 116 turnably; a cam follower roll 122 rotatably carried at the other end of lever 113; a cam plate 123 having a sharp recess 124 in the lower portion; and a spring 125 stretched between the lever portion between cam follower roll 122 and pin 116 to keep cam roll 122 and cam plate 123 in contact.

This paper-bag puller section C operates as follows.

Figure 11:
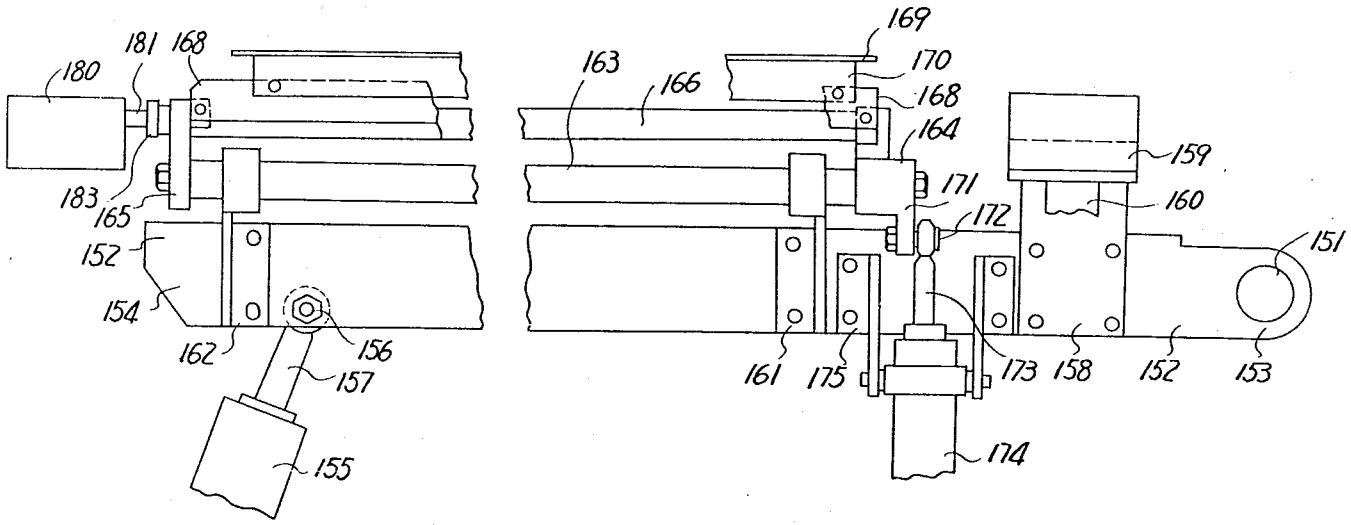
FIG. 11 is a front view of a section for supporting a separate paper bag.
Figure 18:
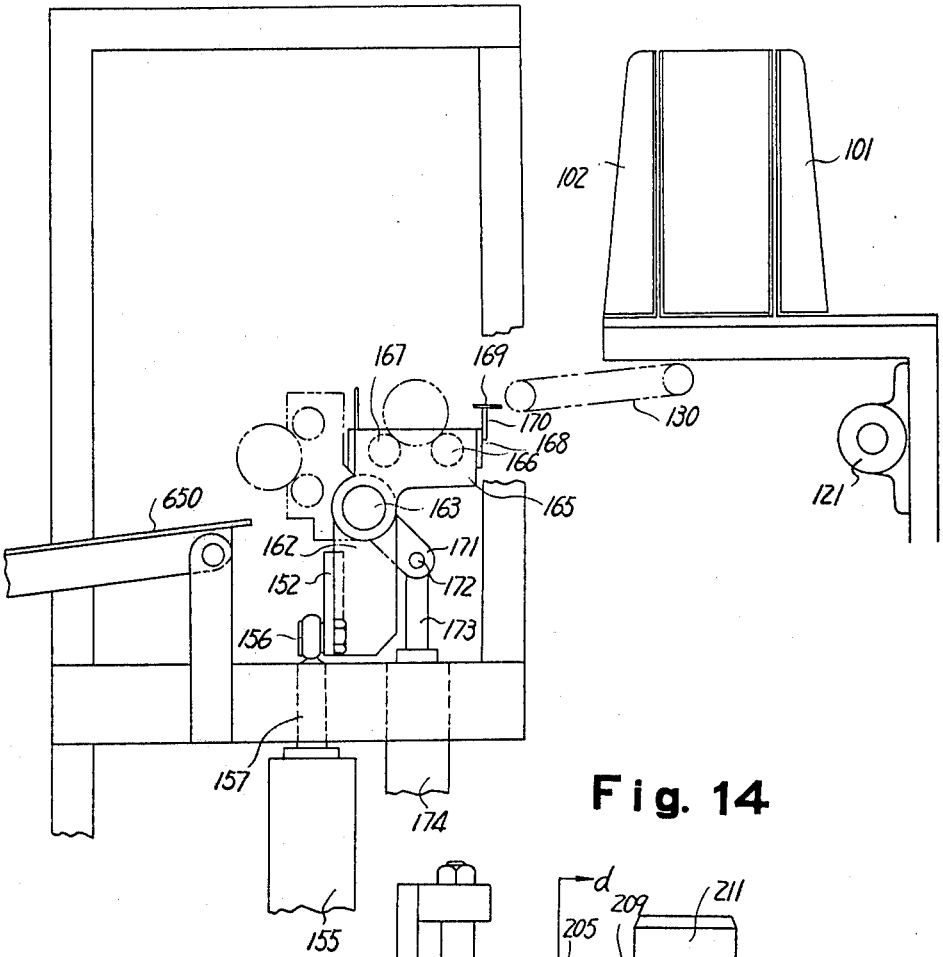
FIG. 18 is a side view of a section for discharging each paper bag filled and closed at the opening.
Figure 14:
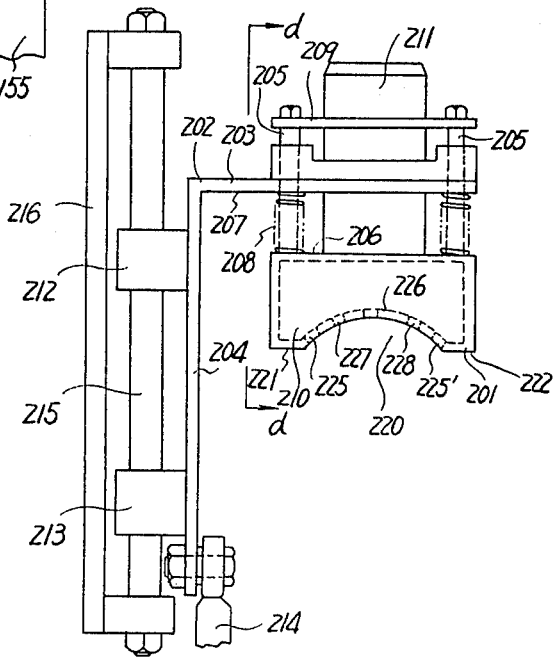
FIG. 14 is a side view of a section for pinching the opening of the paper bag at the both edges parallel to the longitudinal axis of the bag, and then keeping the bag wide open.

As the wheel 120, fast on a rotating shaft 126 journaled by two bearings 127 (FIG. 1), is caused to run in the direction of the arrow (FIG. 10), cam plate 119 fixedly mounted on shaft 126 turns, too, raising cam follower roll 118 in sliding contact therewith, and thereby turning connecting arm 115 clockwise with pin 116. This causes cam follower roll 122 to rise along the surface of cam plate 123 in a plane tilted upwardly to the right as viewed in FIG. 10. As a consequence, suction duct 110 is moved leftward while being raised to the point where the upper surface 111 of the duct contacts the lowermost bag of the stack in stacker 100 and attracts the left-hand portion of the bag by suction from port 112. As cam plate 119 continues to rotate, connecting arm 115 turns counter-clockwise, with the consequence that cam roll 126 moves downward along cam plate 123, and suction duct 110 descends rightward. Following the movement of the suction duct, the left end of the paper bag under suction is disengaged from separating tabs 105 etc. and then, with continued descent of the duct, the right end is released from tabs 104 etc., so that the bag is completely pulled out of the stacker. Further descent of the suction duct causes cam follower roll 122 to fall into recess 124 of cam plate 123, when the suction by duct 110 is immediately interrupted. Then, the paper bag brought down by the duct is set free onto a conveyor belt 130, as shown in FIG. 10, and is transferred, past a guide plate 170, to a separate section D for supporting the bag. This separate bag-supporting section D serves also as an assembly for holding the bag while the latter is being packed with a lot of end closures for cans. It comprises, as illustrated in FIGS. 11 and 18, a vertical flat base plate 152 extending laterally and turnably pivoted with a pin 151 to the upper end 153' (FIG. 1) of frame 253; a connecting rod 157 pivoted with a pin 156 to the opposite end 154 of base plate 52; a swingable air cylinder 155 located at the other end of connecting rod 157; a lower member 159 attached, through a bracket 158, to a portion near one end 153 of base plate 152 to widen the opening of each paper bag; a pipe 160 communicated at one end with a hollow space of lower member 159 for opening the bag (of the same construction as the hollow space of an upper member 201 for bag opening which will be referred to later) and also communicated at the other end with vacuum means (not shown); a shaft 163 rotatably supported by a bearing bracket 161 which, in turn, is attached to a portion of base plate 152 slightly nearer to the other end 154 than bracket 158 and also by another bearing bracket 162 secured near the same end 154; a roll-supporting plates 164, 165 secured to the both ends of the shaft 163 so as to face each other; two turnable rods 166, 167 extended between roll-supporting plates 164, 165 (FIG. 3); a position control plate 168 for controlling the position of the paper bag placed on rods 166, 167; a guide plate 170 extending upward from position control plate 168 and carrying a horizontal plate 169 at the top; a connecting rod 173 pivotally connected by a pin 172 to an arm 171 (FIG. 18), which extends obliquely downward from one of the roll-supporting plates, 164, so that the rod can move parallelly to and turn relative to arm 171; an air cylinder 174 swingably connected to connecting rod 173; and brackets 175 pivotally supporting air cylinder 174 to permit upward, downward, and swinging motions of the cylinder.

Operation of this separate paper-bag supporting section D is as follows.

Each paper bag placed on conveyor 130 by the bag puller section C is conveyed, past horizontal plate 169 of guide plate 170, onto the turnable rods 166, 167. Next, air cylinder 155 is actuated to turn base plate 152, together with rods 166, 167, etc., about pin 151 up to a point on the extension line from central through G (303). The two rods 166, 167 thus brought to a stop are longitudinally inclined and the paper bag thereon will slip downward unless they are pressed in position. In order to avoid the fall and open the paper bag, a section E for holding and opening the bag is provided. The section E, which functions in cooperation with lower bag-opening member 15, comprises, as shown in FIGS. 1, 2, 14 and 15, an upper bag-opening member 201; an inverted-L-shaped plate 202 which serves as a frame for suspending upper member 201; a suitable number of long bolts 205 piercing through the horizontal part 203 of suspending plate 202 and fastened to upper member 201; tension springs 208 which surround the long bolts between the upper surface 206 of upper bag-opening member 201 and the under surface 207 of horizontal plate part 203 to allow suspending plate 202 to carry upper member 201 elastically; a stop plate 209 fitted to the upper ends of long bolts 205 to set a maximum distance between upper member 201 and horizontal part 203; a pipe 211 communicated at one end with hollow space 210 of upper member 201 and at the other end with vacuum means not shown; and arm 214 turnably connected to the lower end portion of vertical part 204 of inverted-L-shaped suspending plate 202; bearings 212, 213 made fast to the side of vertical part 204 of suspending plate 202 opposite to the side where upper member 201 is suspended; a vertical guide rod 215 extending through bearings 212, 213, and a bracket 216 supporting guide rod 215 in place. The under surface of upper bag-opening member 210 is formed of an arcuate recess 220 extended in the direction where the lot of end closures is to travel and flat zones 221, 222 on both sides of recess 220. This recess 220 is shaped to one half of the circumference of the opening of each paper bag when opened wide to a round form. It has large suction ports 225, 225' and 226 formed near the adjacent flat zones and in the center and, in addition, a suitable number of smaller suction ports 227, 228 formed between ports 225 and 226 and between ports 225' and 226. The above-mentioned lower bag-opening member 159 is also of the same construction and shape as upper member 201.

This bag-holding-opening section E operates in the following manner. Just before the paper bag slides down upon tilting of bag-supporting section D, upper bag-opening member 201 is lowered by the descent of vertically movable arm 214 until it elastically pinches the both longitudinal edges of the opening of the bag between the both flat portions of lower bag-opening member 159 and the mating flat portions of upper member 201. The pressure with which the bag is caught is the reaction force that results from the compression of springs 208. Next, after the separate bag-supporting section D has stopped in prescribed inclined position, vacuum is applied through pipe 211 of upper bag-opening member 201 and through pipe 160 of lower member 159. Of the superposed layers of the paper bag, the portions close to the pinched edges are first opened apart, upward and downward, by the suction through the large suction ports. Following this, the pinched portions of the bag (which are simply pinched by elastic means) are caused to slip off by the suction through the rest of suction ports and, in an instant, the opening of the paper bag is fully opened to the inner recessed contours of the upper and lower bag-opening members.

The bag is now fully open up to about 15 cm from the open end and is thence gradually closed toward the opposite end which is sealed, most of the bag remaining flatly closed.

After the opening of the paper bag, a hollow guide cylinder is inserted into the open portion of the bag to prepare for the introduction of a lot of end closures from the trough G" into the bag.

The guide cylinder part K for this purpose comprises, as shown in FIG. 1, a hollow guide cylinder 451; a stationary arm 452 hanging down from the rear of guide cylinder 451; a drive arm 453 for moving the guide cylinder back and forth in parallel with the direction of travel of the end closures, and support rails (not shown) for supporting the guide cylinder during its reciprocating movement. The guide cylinder has an outside diameter slightly smaller than the diameter of the rounded opening of the bag. To facilitate the insertion into the bag, the guide cylinder wall is tapered at the front end.

Operation of this guide cylinder section K is as follows. After the opening of the paper bag has been fully opened, drive arm 453 is actuated to move guide cylinder 451 forward into the open portion of the bag, to a depth of about 15 cm from the open end. Following the introduction of a lot of end closures, the cylinder is withdrawn from the bag to the original position.

At the time of introduction the lot of end closures for cans is forced deep into the bag, down to the closed end, when the bag is subjected to a pressure urging it obliquely upward. Therefore, the arrangements are so designed that, after the insertion of the guide cylinder, upper bag-opening member 201 is moved further downward to increase the pinch on the paper bag between guide cylinder 451 and recess 220 of upper member 201. After the paper bag has been pinched firmly, the lot of end closures in the central trough G" is forced through the hollow of the guide cylinders into the bag by the action of a lot-inserting feed section H which consists essentially of an air cylinder and a push rod 351 (FIG. 1) to be moved back and forth by the air cylinder.

Next, the paper bag is closed at the open end by twisting.

Figure 16:
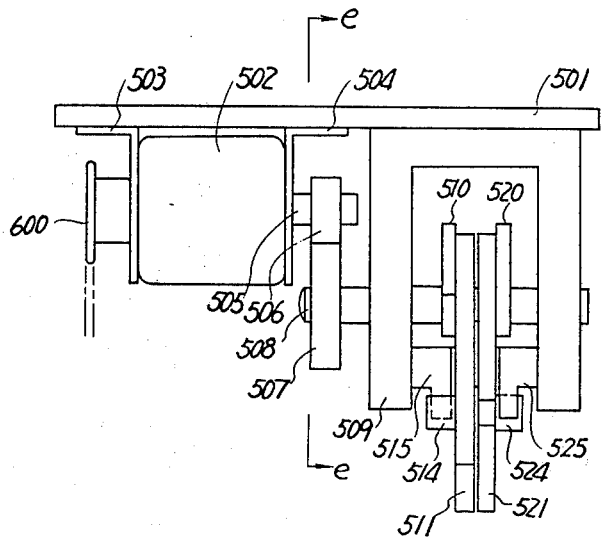
FIG. 16 is a front view of a section for squeezing the opening of each paper bag.
Figure 17:
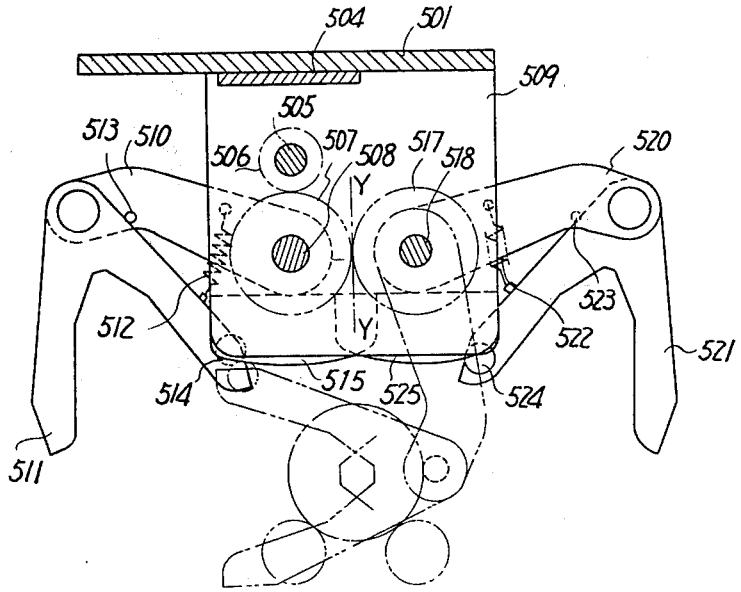
FIG. 17 is a sectional view looking in the direction of the arrows e—e of FIG. 16.

A section E' for twisting and closing each bag at the open end consists of a pinching part indicated in FIGS. 1, 16 and 17 and a bag-turning part in FIGS. 12 and 13. The pinching part, in turn, consists of a stationary base plate 501 fixed to a frame (not shown) and components attached to or supported by the under surface of the base plate. The components include, as shown in FIG. 16, a small motor 502; brackets 503, 504 for the motor; a drive shaft 505 extended horizontally from the motor rightwardly as viewed in the drawing; a gear 506 fixedly mounted on drive shaft 505; a driven gear 507 in mesh with gear 506; a rotating shaft 508 of driven gear 507; an inverted-U-shaped bearing 509 supporting rotating shaft 508 and secured to base plate 501; an arm 510 located within the inverted U space of bearing 509 and anchored at one end to shaft 508; an open-legged pincer-like member 511 turnably mounted on a pin set on the other end of arm 510; a spring 512 stretched between arm 510 and pincer-like member 511; a stop pin 513 provided on arm 510 to define the angle of minimum opening between arm 510 and pincer-like member 511 under the urgings of spring 512; a rotating shaft 518 located in parallel and at the same level with rotating shaft 518; and a gear 517 mounted on shaft 518 in mesh with driven gear 507. Also among the components are an arm 520, open-legged pincer-like member 521, tension spring 522, and stop pin 523 all arranged in a mirror-like symmetry with arm 510, open-legged pincer-like member 511, tension spring 512, and stop pin 513, with respect to the common tangential line Y—Y between driven gear 507 on shaft 518 and gear 517. The part further comprises cam plates 515, 525 fixed to inverted-U-shaped bearing 509 in the lower portion of the U space; a cam follower roll 514 attached to the end of an upper leg of open-legged pincer-like member 511 and rotatable in contact with cam plate 515; and a cam follower roll 524 similarly attached to the open-legged pincer-like member 521 and rotatable in contact with cam plate 525. Open-legged pincer-like members 511 and 512 are staggered to pass close by each other.

On a shaft extended leftwardly of small motor 502 as viewed in the figure is fixedly mounted a sprocket 600, which is employed to drive bag-turning rolls to be described later. Referring to FIGS. 1, 12 and 13, the bag-turning part comprises a sprocket 530 to be driven by sprocket 600; a rotating shaft 531 on one end of which sprocket 530 is mounted; bearings 533, 534 suspended from and attached to a flat base plate 532 so as to support rotating shaft 531; a rotatable cam plate 535 mounted on the opposite end of rotating shaft 530; a cam follower roll 536 in rolling contact with the periphery of cam plate 535; a rocking arm 546 carrying cam follower roll 536 rotatably at one end, and rockably pivoted midway to a shaft 536, carrying arms 540, 541 turnably at the other end; bearings 537, 538 supporting shaft 539; an upper roll 550 mounted on the other end of arm 540; an upper roll 551 mounted on the other end of arm 541; an actuating arm 543 extending from arm 546 in the direction opposite to cam follower roll 536 and engaged at the end with one end of a spring 542, which serves to press cam follower roll 536 against cam plate 535; a spring holder 544 engaged with the other end of spring 542; and a spring 545 biasing arms 540, 541 of rolls 550, 551 toward each other. With these components the bag-turning part is operatively associated with the two turnable rods 166, 167 of bag-supporting section D.

Turnable rods 166, 167 support the paper bag that holds a lot of end closures for cans and, for the turning of those rods, there are provided, as shown in FIGS. 11, 2 and 3, a small motor 180 with an output shaft 181, a gear 182 mounted on shaft 181, and gears 183, 184 mounted on rods 166, 167 in mesh with gear 182.

The section E′ for twisting and closing each bag at the open end and the bag-turning part operate as follows.

As already stated, the lot of end closures pinched between guide cylinder 451 and upper bag-opening member 201 is forced into the paper bag by push rod 351. The push rod stops with its front end thrusted deep in the bag, past the mouth of the guide cylinder.

When the lot of end closures stands in the support trough without the application of any pressure, the individual pieces are not in close contact but in partial contact with one another because of their own distorsion. Consequently, the length of the loose lot is about 20 to 50% greater than that of the lot in which the pieces are fully and tightly in contact. The forceful introduction of the lot into the bag compresses the mass, decreasing the length considerably from that in the support trough. Therefore, if guide cylinder 451 and upper bag-opening member 201 release their hold on the bag, the bag will be moved forward, leaving part of the pieces exposed behind. To avoid this, open-legged pincer-like members 511, 521 on the left and right of the opening-pinching section E′ draw close to each other at a point between the front end of the guide cylinder and the rearmost of the end closures as a lot in the paper bag, so as to squeeze that portion of the round-shaped paper bag. When the round-shaped portion has been reduced in size to about one half of the original, upper bag-opening member 201 rises and guide cylinder 451 recedes out of the bag to the initial position. In this way upper bag-opening member 201 and guide cylinder 451 release the bag. Since the paper bag is squeezed by open-legged pincer-like members 511, 521 only at the portion between the open end and the bag portion filled with the lot of end closures, there is no possibility of the open end of the bag passing forward through the gap formed by the both open-legged pincer-like members.

The pincer-like members are further moved closer to each other and, immediately before they pinch the bag firmly, push rod 351 is retracted out of the bag. Squeezing the bag to this degree prevents the rearmost one of the end closures from falling within the paper bag.

During the squeezing of the bag to this point, rolls 550, 551 of the bag-turning part are actuated by the rotation of cam plate 535 to press the portion of the paper bag containing the end closures on turnable rods 166, 167 of separate bag-supporting section D against the rods. In this manner the bag portion is held between turnable rods 166, 167 and rolls 550, 551. During, or before or after, the retraction of push rod 351, small motor 180 for driving rods 166, 167 secured by suitable means to roll-supporting plates 164, 165 (see FIGS. 11 and 3) starts running. Its rotational power is transmitted through the output shaft 181 of the motor, gear 182 mounted on the shaft, and gears 183, 184 meshed with gear 182 and mounted, respectively, on rods 166, 167, in the order mentioned, to turn the paper bag. As it turns, the bag is twisted relative to the portion held by pincer-like members 511, 521. With the progress of twisting the pincer-like members draw even closer to each other and close the paper bag by sufficiently twisting it about the portion where the members maintain the pinch. The bag will be closed more effectively if the bag is turned once more through an angle of about 180 deg. after the pincer-like members have been sufficiently drawn close to each other. After this, motor 180 is stopped.

Next, separate bag-supporting section D is moved downward by air cylinder 155 to the original position where the round rods and therefore the paper bag lying thereon are horizontal. Connecting rod 173 of air cylinder 174 then rises, with the result that, about shaft 163 (FIG. 18), arm 171 turnably pivoted at one end to connecting rod 173 by pin 172, roll-supporting plate 165 integral with arm 171, and turnable rods 166, 167 are all moved to the points indicated by two-dot chain lines. The paper bag now packed with the end closures is released from rods 166, 167 onto a delivery table 650. The turnable rods and associated parts are brought back by the action of air cylinder 174 to the points indicated by full lines in FIG. 18.

The embodiment of the apparatus of the present invention so far described, which includes the components described in detail and uses well-known timing means to actuate those components according to a schedule, can count up a predetermined number of end closures for cans, divide them into lots, put each lot into a paper bag, close the open end of the bag, and delivery it to the outside, all in an automatized operation. The counting and lotting are done rapidly and accurately at a handling rate of 300 pieces of end closures a minute. The bags packed with the end closures are completely closed to protect the contents.

While the embodiment of the invention has been described as including arrangements in which the sequence of counting and lotting is accomplished in two separate regions and the lots of end closures from the two regions are alternately fed to a single bagging zone for introduction into paper bags, it is not an essential requirement of the invention; the end closures may be counted up and divided into lots in one region, instead, for direct introduction into paper bags.

The method of the invention comprises novel steps and, by a combination of those steps, makes possible the automatization of rapid and accurate counting and division of end closures for cans into lots and subsequent packing of each lot into a paper bag.

It will be apparent that various changes in form and details can be made to the method of the invention without departing from the spirit and scope thereof, the forms hereinbefore described being merely preferred embodiments thereof.

What is claimed is:

1. A method of automatically bagging end closures for cans which comprises the steps of:

sliding end closures at given intervals, one after another, downwardly through an inclined chute to a support passage which extends substantially horizontally, receiving said end closures at said passage in such a way that each piece is inclined with the lower portion thereof ahead of the upper portion in said passage and said lower portion is positioned in the proximity of a pair of rotating rolls having peripheral surfaces partly entering said passage, attracting by suction the forwardly inclined lower portion of the piece rearwardly and the upper portion forwardly to bring said piece to an upright position substantially perpendicular to said support passage and to bring said piece into contact with said rotating rolls, and forcing such upright pieces forward through said rotating rolls, counting the number of end closures being fed before they enter said passage, and lotting out said end closures which have been passed between said rotating rolls to form a lot of a predetermined number of pieces in response to a signal indicating that said predetermined number of end closures has been counted, opening an elongate paper bag, inserting a hollow guide cylinder into the open portion of said bag, pressing said open portion against the outer surface of said cylinder and thereby firmly holding said bag, and introducing said lot of end closures through the hollow of said cylinder into said bag while it is so held in position by a push rod which is entered into said bag through the hollow of said cylinder, and closing said bag packed with said lot of end closures by twisting the open end of the bag.

2. A method according to claim 1, wherein said step of opening a paper bag comprises pinching by elastic means a flat, elongate paper bag, which is closed at one end and open at the other, along opposite edges parallel to the axis of said bag adjacent to the open end, and attracting by suction the superposed layers of said bag adjacent to its open end between the pinched edges in opposite directions until said pinched edges are caused to slip off from said elastic means to form an opening.

3. A method according to claim 1, wherein said step of closing said open end of said paper bag comprises releasing the pressure of said open end of said bag adjacent said guide cylinder, withdrawing said guide cylinder from said bag after bringing open legs of a pair of pincer-like members close to each other at a portion between the front end of said guide cylinder and the rearmost of the end closures in said paper bag so as to squeeze said portion to about one half of its original size, then retracting said push rod out of said bag, then immediately moving said pincer-like members closer to one another so as to pinch said bag firmly, and further squeezing said bag with said pincer-like members while imparting rotation along the longitudinal axis of said paper bag to the portion of said bag filled with said end closures.

4. A method according to claim 3, further comprising the step of continuing the rotation of said filled portion of said bag after said further squeezing step.

* * * * *